US008372567B2

(12) United States Patent
Nakamura et al.

(10) Patent No.: US 8,372,567 B2
(45) Date of Patent: Feb. 12, 2013

(54) ELECTROPHOTOGRAPHIC PHOTORECEPTOR AND MANUFACTURING METHOD THEREFOR

(75) Inventors: Yoichi Nakamura, Nagano (JP); Seizo Kitagawa, Nagano (JP); Hiroshi Emori, Nagano (JP); Yasushi Tanaka, Nagano (JP); Hiroyuki Ichiyanagi, Nagano (JP)

(73) Assignee: Fuji Electric Co., Ltd., Kawasaki-shi (JP)

( * ) Notice: Subject to any disclaimer, the term of this patent is extended or adjusted under 35 U.S.C. 154(b) by 223 days.

(21) Appl. No.: 12/735,704

(22) PCT Filed: May 28, 2009

(86) PCT No.: PCT/JP2009/059787

§ 371 (c)(1),
(2), (4) Date: Dec. 29, 2010

(87) PCT Pub. No.: WO2009/145262

PCT Pub. Date: Dec. 3, 2009

(65) Prior Publication Data

US 2011/0091799 A1 Apr. 21, 2011

(30) Foreign Application Priority Data

May 29, 2008 (JP) ..... 2008-141627

(51) Int. Cl.
*G03G 5/00* (2006.01)

(52) U.S. Cl. ..... 430/58.05; 430/59.6; 430/133

(58) Field of Classification Search ..... 430/58.05, 430/59.6, 133
See application file for complete search history.

(56) References Cited

U.S. PATENT DOCUMENTS

| | | | |
|---|---|---|---|
| 3,926,626 | A | 12/1975 | Bean |
| 4,863,823 | A | 9/1989 | Hiro et al. |
| 5,028,502 | A | 7/1991 | Yuh et al. |
| 5,389,477 | A | 2/1995 | Tsuchiya et al. |
| 5,536,611 | A | 7/1996 | Arudi et al. |
| 2010/0028791 | A1 | 2/2010 | Takaki et al. |

FOREIGN PATENT DOCUMENTS

| | | | |
|---|---|---|---|
| GB | 1072557 | A | 6/1967 |
| JP | 61-034547 | A | 2/1986 |
| JP | 61-048868 | A | 3/1986 |
| JP | 62-231262 | A | 10/1987 |
| JP | 63-249152 | A | 10/1988 |
| JP | 01-164955 | A | 6/1989 |
| JP | 02-129648 | A | 5/1990 |
| JP | 03-231250 | A | 10/1991 |

(Continued)

OTHER PUBLICATIONS

Itami et al.,"Development of High Durable Organic Photoreceptor", Konica Technical Report, vol. 14 (2001), pp. 43-46.

*Primary Examiner* — Mark A Chapman
(74) *Attorney, Agent, or Firm* — Rabin & Berdo, P.C.

(57) ABSTRACT

In an electrophotographic photoreceptor having a photosensitive layer on an electroconductive substrate, the photosensitive layer is a positive-charging laminate comprising at least a charge transport layer and a charge generating layer laminated in that order, with the charge generating layer containing at least a resin binder, a charge generating agent, a space filler and an electron transport agent, while the charge transport layer contains at least, as a resin binder, polystyrene and a hole transport agent, and mineral oil of the charge transport layer is in an amount of 1% by mass or less of an amount of polystyrene. Thus, a highly durable and economic positive-charging multilayer electrophotographic photoreceptor and a manufacturing method therefor may be achieved.

19 Claims, 1 Drawing Sheet

FOREIGN PATENT DOCUMENTS

| | | | |
|---|---|---|---|
| JP | 04-233547 | A | 8/1992 |
| JP | 04-242259 | A | 8/1992 |
| JP | 04-324449 | A | 11/1992 |
| JP | 05-100453 | A | 4/1993 |
| JP | 05-165237 | A | 7/1993 |
| JP | 8-278651 | A | 10/1996 |
| JP | 09-304950 | A | 11/1997 |
| JP | 2000-199980 | A | 7/2000 |
| JP | 2001-100596 | A | 4/2001 |
| JP | 2002-049163 | A | 2/2002 |
| JP | 2002-182416 | A | 6/2002 |
| JP | 2003-316038 | A | 11/2003 |
| JP | 2007-147824 | A | 6/2007 |
| JP | 2007-279446 | A | 10/2007 |
| JP | 2008-051991 | A | 3/2008 |
| NL | 6410840 | A | 3/1965 |

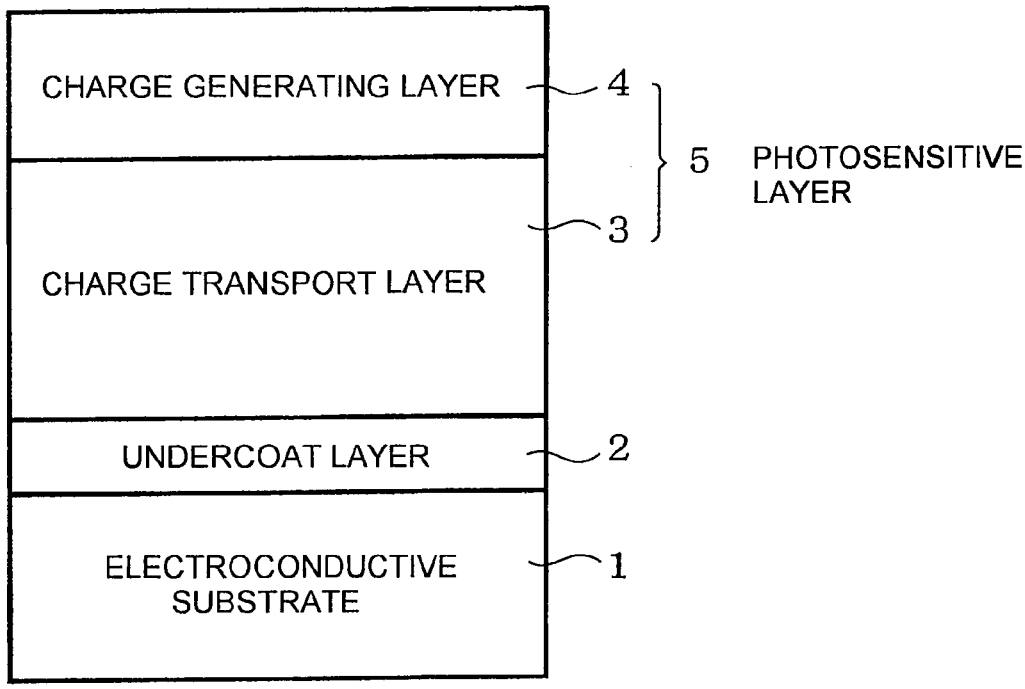
CHARGE GENERATING LAYER
4
5
PHOTOSENSITIVE LAYER
3
CHARGE TRANSPORT LAYER
UNDERCOAT LAYER
2
ELECTROCONDUCTIVE SUBSTRATE
1

ELECTROPHOTOGRAPHIC PHOTORECEPTOR AND MANUFACTURING METHOD THEREFOR

TECHNICAL FIELD

The present invention relates to an electrophotographic photoreceptor for use in electrophotographic printers, copying machines and facsimile machines, and to a manufacturing method therefor, and relates more particularly to a highly durable and economical positive-charging multilayer electrophotographic photoreceptor (hereunder sometimes called a "photoreceptor"), and to a manufacturing method therefor.

BACKGROUND ART

An electrophotographic photoreceptor must have the functions of holding surface charge in dark environments, generating charge upon receiving light and also transporting charge upon receiving light, and there exist both single-layer receptors, which combine all these functions in one layer, and multilayer receptors, which consist of stacked layers with separate functions—primarily a layer that contributes to charge generation and a layer that contributes to holding surface charge in dark environments and transporting charge upon receiving light.

The Carlson method for example is applicable to image formation by electrophotography using these electrophotographic photoreceptors. In this system, image formation involves electrification by corona discharge and contact with the receptor in a dark environment, formation of the letters, pictures or other electrostatic images from a manuscript on the surface of the electrified photoreceptor, development of the electrostatic images by means of a toner, and transference and attachment of the developed toner image on a paper or other support. After transference of the toner image, the photoreceptor can be reused after residual toner removal and optical neutralization as necessary.

Conventionally, the photosensitive materials of these electrophotographic photoreceptors have consisted of inorganic photoconducting substance such as selenium, selenium alloys, zinc oxide, cadmium sulfide and the like dissolved and dispersed in resin binders, or of organic photoconducting materials such as poly-N-vinylcarbazole, 9,10-anthracenediol polyester, hydrazone, stilbene, benzidine, triphenylamine, phthalocyanine, bisazo compounds and the like dissolved and dispersed in resin binders, or of such photoconducting substance as vacuum deposits or sublimates.

Known resin binders for use in electrophotographic receptors include polyamide, epoxy resin, alkyd resin, poly aryl resin, polyvinyl chloride, polyvinyl acetate, polyketals, silicone resin, polystyrene, polymethyl methacrylate, polycarbonate and the like.

Of these, polystyrene is known to be cheap and economical, and electrophotographic receptors using polystyrene have been reported in various patent documents and the like. For example, Netherlands Patent No. 6410840 gives a typical example as a base material for forming a photosensitive layer. U.S. Pat. No. 3,926,626 gives a typical example as a soft insulating layer material for a photoreceptor. Japanese Patent Application Laid-open No. H5-165237 gives a general example of a resin binder consisting of polystyrene that is combined with X-form metal-free phthalocyanine and an oxazole compound, and then dissolved in a solvent.

Thus, polystyrene is generally known as a material for use in electrophotographic photoreceptors, but because photosensitive layers using polystyrene have an extremely large permanent deformation rate as shown in Itami et al., Konica Technical Report, (14), 43 (2001) ("Konica Technical Report"), they have poor wear resistance and are not used for practical applications. Instead, expensive resin binders such as polycarbonate and poly aryl are presently used.

In addition, mineral oil is sometimes added to polystyrene in order to improve fluidity and the like during use in molding applications.

Currently, however, various positive-charging multilayer electrophotographic photoreceptors are being reported in the field of electrophotographic photoreceptors, and for example Japanese Patent Application Laid-open No. S61-34547 reports on one consisting of a charge transport layer containing a charge transport material comprising an electron donating compound and a charge generating layer containing a specific crystalline metal-free phthalocyanine layered successively on an electroconductive layer. Japanese Patent Application Laid-open No. S61-48868 reports on forming a blocking layer containing a specific charge transport material under a single photosensitive layer containing a specific charge generating substance. Japanese Patent Application Laid-open No. S62-231262 reports on successively layering a charge transport layer containing a specific substance and a charge generating layer containing a specific substance, and gives polystyrene as one example of a binder resin for the charge transport layer. Finally, Japanese Patent Application Laid-open No. H4-242259 reports on an electrophotographic photoreceptor having a carrier transport layer and a carrier generating layer in that order on an electroconductive substrate, wherein the carrier generating layer contains a P-type carrier transport material and an N-type carrier transport material.

As discussed above, it is known that polystyrene is economical for use as a resin binder in electrophotographic photoreceptors, and that some electrophotographic photoreceptors are of the positive-charging multilayer type, but the wear resistance properties and durability of positive-charging multilayer electrophotographic photoreceptors may not be satisfactory when polystyrene is used as the resin binder.

DISCLOSURE OF THE INVENTION

It is therefore an object of the present invention to provide a highly durable and economical positive-charging multilayer electrophotographic photoreceptor, and a manufacturing method therefor.

In an effort to solve the problems discussed above, the inventors in this case carried out exhaustive research on the effects of polystyrene, space fillers and mineral oil on the durability of electrophotographic photoreceptors, and perfected the present invention after discovering that this object could be achieved if the mineral oil content of the polystyrene used as a resin binder was no more than a specific amount.

That is, the present invention may be described as a positive-charging multilayer electrophotographic photoreceptor having an electroconductive substrate, and a photosensitive layer disposed over the electroconductive substrate and including a charge transport layer including a resin binder including polystyrene and a hole transport agent, and mineral oil in an amount of 1% by mass or less of an amount of the polystyrene, and a charge generating layer disposed over the charge transport layer, and including a resin binder, a charge generating agent, a space filler and an electron transport agent.

The electrophotographic photoreceptor manufacturing method of the present invention may be described as a method of forming a photosensitive layer for manufacturing an electrophotographic photoreceptor, including applying a charge generating layer coating liquid including a resin binder including a charge generating agent, a space filler and an electron transport agent over an electroconductive substrate, and applying a charge transport layer coating liquid over the charge generating layer coating liquid, the charge transport layer coating liquid including a resin binder including polystyrene and a hole transport agent, and mineral oil in an amount of 1% by mass or less of an amount of the polystyrene.

In the present invention, the mechanism by which durability is greatly improved may be as follows.

That is, because photosensitive layers using polystyrene have an extremely large permanent deformation rate as shown in the Konica Technical Report, they have conventionally been weak in terms of wear resistance and creep deformation. When the mineral oil content of such polystyrene exceeds 1% by mass, the effects of movement of the mineral oil in the coated film become evident, and the film may become particularly liable to creep deformation. However, if a relatively hard polycarbonate or the like is used for the resin binder in the charge generating layer (outermost surface layer), and a space filler is added, a harder coated film is obtained because the spaces in the polycarbonate or other polymer structure are filled in at the molecular level, and the outside of the polystyrene coated film is thus covered with a hard shell. Thus, durability can be improved even using polystyrene. Polystyrene is one of the most widely used mass-produced resins in the world, and makes the product more economical because of its cheapness.

With the present invention it is possible to provide a highly durable and economical positive-charging multilayer electrophotographic photoreceptor, and a manufacturing method therefor.

BRIEF DESCRIPTION OF THE DRAWINGS

FIG. 1 is a cross-section of a positive-charging multilayer electrophotographic photoreceptor of one embodiment of the present invention

BEST MODE FOR CARRYING OUT THE INVENTION

Embodiments of the electrophotographic photoreceptor of the present invention are explained in detail below with reference to the drawings.

FIG. 1 is a cross-section of a typical positive-charging multilayer electrophotographic photoreceptor. Undercoat layer 2 is provided as necessary on electroconductive substrate 1, followed by photosensitive layer 5 including charge transport layer 3 having a charge transport function and charge generating layer 4 having a charge generating function in that order.

Electroconductive substrate 1, which serves simultaneously as an electrode of the photoreceptor and as a support for the other layers, may be in the form of a tube, plate, film or the like, and may be made of aluminum or another metal or of glass, resin and the like which has been given an electroconductive treatment.

Undercoat layer 2 is provided as necessary in order to improve the surface properties, adhesiveness, charge blocking properties and the like of electroconductive substrate 1, and may be made of an alcohol-soluble polyamide, solvent-soluble aromatic polyamide, solvent-soluble alkide resin, thermally cured melamine resin and the like. An inorganic fine powder such as titanium dioxide, alumina, calcium carbonate, silica or the like may also be added thereto as necessary.

Charge transport layer 3 is a coated film formed by coating a material consisting of a triphenylamine, stilbene, benzidine, hydrazone or other hole transport agent, either alone or in combination, dissolved in polystyrene as a resin binder. It is essential that the mineral oil content of this charge transport layer 3 be 1% by mass or less of the polystyrene content.

In a dark environment, this charge transport layer 3 acts as an insulating layer to hold the charge of the photoreceptor, but upon receiving light it functions to transport the charge injected from charge generating layer 4. To maximize this function, the content of the hole transport agent should preferably be 20 to 80% by mass of the solids portion of charge transport layer 3. Phenol, phosphonite and other antioxidants and the like can be added thereto as necessary.

The thickness of charge transport layer 3 is preferably in the range of 3 to 5 μm in order to maintain an effective surface charge for practical purposes.

Charge generating layer 4 is a coated layer formed by coating a material consisting of a combination of at least a space filler, a charge generating agent, an electron transport agent and a resin binder.

This charge generating layer 4 has the function of generating charge upon receiving light. It is important that charge generating layer 4 have both a high charge generating efficiency and the ability to inject generated charge into charge transport layer 3, and preferably it should have little field dependence, with good injection properties even in low electrical fields. To obtain these functions, the content of the space filler should preferably to 1 to 20% by mass of the solids portion of charge generating layer 4. The content of the charge generating agent should preferably be 0.1 to 5% by mass of the solids portion of charge generating layer 4. The content of the electron transport agent should preferably be 20 to 80% by mass of the solids portion of charge generating layer 4. A hole transport agent may also be included in charge generating layer 4 as necessary, and this may be the same as or different from the hole transport agent of charge transport layer 3. Phenol, phosphonite and other antioxidants and the like can also be added as necessary.

A triphenylamine, triphenylbenzene, aromatic ester or the like can be used as the space filler.

The charge generating agent may be a phthalocyanine or azo pigment or dye or the like. A dispersion aid can also be used.

An azoquinone, benzoquinone or naphthoquinone agent or the like can be used as the electron transport agent.

Polycarbonate, poly aryl and the like can be used either alone or in combination as the resin binder for the charge generating layer.

The thickness of charge generating layer 4 is preferably in the range of 3 to 5 μm in order to maintain a good surface charge for practical purposes.

In the present invention, appropriate materials, methods and the like can be selected as necessary from known materials and methods for manufacture as long as polystyrene is used together with a space filler and the mineral oil content is kept at 1% by mass or less as described above. The coating liquids in the manufacturing method of the present invention can be applied by a variety of known coating methods such as dip coating, spray coating and the like, with no particular limitations on the coating method in any case.

EXAMPLES

Detailed examples of the present invention are given below, but the present invention is not limited by these examples. Moreover, the chemical names of the hole transport agents, antioxidants, space fillers and electron transport agents are all represented by the registry numbers of the American Chemical Society's Chemical Abstract Service (CAS), which assigns a unique number to each individual compound.

Synthesis Example 1

600 g of o-phthalodinitrile (Tokyo Chemical Industry, Inc.), 300 g of formamide (Kanto Chemical), 100 g of sodium methoxide (Kanto Chemical) and 1.0 liter of N-methyl-2-pyrrolidinone (Kanto Chemical) were added to a reaction container, and agitated in a nitrogen atmosphere. This was then heated and agitated for 15 hours at 180° C.

This reaction liquid was left to cool to 130° C., filtered, and washed with 3 liters of N-methyl-2-pyrrolidinone. This wet cake was heated and agitated for 1 hour at 120° C. with 1.0 liter of N-methyl-2-pyrrolidinone in a nitrogen atmosphere. This was left to cool, filtered, and washed successively with 3 liters of N-methyl-2-pyrrolidinone, 1 liter of acetone (Kanto Chemical) and 4 liters of warm pure water to obtain a wet cake.

This wet cake was further heated and agitated for 1 hour at 80° C. in dilute hydrochloric acid consisting of 4 liters of water and 360 milliliters of 36% hydrochloric acid (Kanto Chemical). This was left to cool, filtered, washed with 4 liters of warm pure water, and dried to obtain crude metal-free phthalocyanine.

200 g of this metal-free phthalocyanine was added with cooling and agitation to 4 kg of 96% sulfuric acid (Kanto Chemical) at −5° C. so that the liquid temperature did not exceed −5° C. This sulfuric acid solution was then added with cooling and agitation to 35 liters of water and 5 kg of ice so that the liquid temperature did not exceed 10° C., and cooled and agitated for 1 hour. This was filtered and washed with 10 liters of warm water to obtain a wet cake.

This wet cake was further mixed with dilute hydrochloric acid consisting of 10 liters of water and 770 milliliters of 36% hydrochloric acid, and heated and agitated for 1 hour at 80° C. This was left to cool, filtered, and washed with 10 liters of warm water to obtain a wet cake.

This wet cake was milled together with 1.5 liters of o-dichlorobenzene (Kanto Chemical) in a ball mill apparatus. This was extracted with 1.5 liters of acetone and 1.5 liters of methanol, filtered, washed with 1.5 liters of pure water, and dried to manufacture metal-free phthalocyanine.

Synthesis Example 2

800 g of o-phthalodinitrile and 1.8 liters of quinoline (Kanto Chemical) were added to a reaction container and agitated. 297 g of titanium tetrachloride (Kishida Chemical Co.) were dripped in a nitrogen atmosphere, and agitated. After dripping, this was heated and agitated for 15 hours at 180° C.

This reaction solution was cooled to 130° C. and then filtered and washed with 3 liters of N-methyl-2-pyrrolidinone. This wet cake was heated and agitated for 1 hour at 160° C. in 1.8 liters of N-methyl-2-pyrrolidinone in a nitrogen atmosphere. This was left to cool, filtered, and washed successively with 3 liters of N-methyl-2-pyrrolidinone, 2 liters of acetone, 2 liters of methanol and 4 liters of warm water to obtain a wet cake.

This wet cake was further heated and agitated for 1 hour at 80° C. in dilute hydrochloric acid consisting of 4 liters of water and 360 milliliters of 36% hydrochloric acid. This was left to cool, filtered, washed with 4 liters of war water and dried to obtain crude titanyl phthalocyanine.

200 g of this titanyl phthalocyanine was added with cooling and agitation to 4 kg of 96% sulfuric acid at −5° C. so that the liquid temperature did not exceed −5° C. This was then cooled and agitated for 1 hour with the temperature maintained at −5° C. This sulfuric acid solution was then added with cooling and agitation to 35 liters of water and 5 kg of ice so that the liquid temperature did not exceed 10° C., and cooled and agitated for 1 hour. This was filtered and washed with 10 liters of warm water to obtain a wet cake.

This wet cake was further mixed with dilute hydrochloric acid consisting of 10 liters of water and 770 milliliters of 36% hydrochloric acid, and heated and agitated for 1 hour at 80° C. This was left to cool, filtered, and washed with 10 liters of warm water to obtain a wet cake.

This wet cake was milled together with 1.5 liters of o-dichlorobenzene (Kanto Chemical) in a ball mill apparatus. This was extracted with 1.5 liters of acetone and 1.5 liters of methanol, filtered, washed with 1.5 liters of pure water, and dried to manufacture titanyl phthalocyanine.

Example 1

100 parts by mass polystyrene (PS Japan PS680), 100 parts by mass stilbene hole transport agent (Takasago International, CAS 211757-52-7), 1 part by weight phenol antioxidant (Kirin Foods, CAS 128-37-0), 3 parts by weight phosphonite antioxidant (Wako Pure Chemical, CAS 70146-21-3) and 796 parts by weight dichloromethane (Wako Pure Chemical) were dissolved and mixed to prepare a charge transport layer coating liquid. This charge transport layer coating liquid was coated by dip coating on an aluminum substrate to form a charge transport layer with a dried thickness of 20 μm.

120 parts by mass polycarbonate Z (Mitsubishi Gas Chemical, Iupizeta PCZ-500), 4 parts by mass of the phthalocyanine charge generating agent of metal-free phthalocyanine manufactured in Synthesis Example 1, 50 parts by mass of azoquinone electron transport agent (Takasago International, CAS 270578-51-3), 30 parts by mass of stilbene hole transport agent (Takasago International, CAS 211757-52-7), 6 parts by mass of an aromatic ester space filler (ADEKA, CAS 124906-78-1) and 790 parts by weight of dichloromethane were dispersed, dissolved and mixed to prepare a charge generating layer coating liquid.

An electrophotographic photoreceptor was manufactured by applying this charge generating layer coating liquid by dip coating atop the previous charge transport layer to form a charge generating layer with a dried thickness of 10 μm.

Example 2

An electrophotographic photoreceptor was manufactured as in Example 1 except that the stilbene hole transport agent used in Example 1 was replaced with a triphenylamine hole transport agent (Takasago International, CAS 1159-53-1) in all cases.

Example 3

An electrophotographic photoreceptor was manufactured as in Example 1 except that the stilbene hole transport agent used in Example 1 was replaced with a benzidine hole transport agent (Takasago International, CAS 105465-13-2) in all cases.

Example 4

An electrophotographic photoreceptor was manufactured as in Example 1 except that the stilbene hole transport agent used in Example 1 was replaced with a hydrazone hole transport agent (Takasago International, CAS 122837-51-8) in all cases.

Example 5

An electrophotographic photoreceptor was manufactured as in Example 1 except that the azoquinone electron transport agent used in Example 1 was replaced with a benzoquinone electron transport agent (Taiwan Fluoro Technology, CAS 2455-14-3).

Example 6

An electrophotographic photoreceptor was manufactured as in Example 1 except that the azoquinone electron transport agent used in Example 1 was replaced with a naphthoquinone electron transport agent (Taiwan Fluoro Technology, CAS 334634-19-4).

Example 7

An electrophotographic photoreceptor was manufactured as in Example 1 except that the aromatic ester space filler used in Example 1 was replaced with a triphenylbenzene space filler (Sigma Aldrich Japan, CAS 612-71-5).

Example 8

An electrophotographic photoreceptor was manufactured as in Example 1 except that the phthalocyanine charge generating agent of metal-free phthalocyanine in Example 1 was replaced with the phthalocyanine charge generating agent of titanyl phthalocyanine manufactured in Example 2.

Example 9

100 parts by mass of polystyrene (PS Japan, PS680), 100 parts by mass of stilbene hole transport agent (Takasago International, CAS 211757-52-7), 1 part by mass of phenol antioxidant (Kirin Foods, CAS 128-37-0), 3 parts by mass of phosphonite antioxidant (Wako Pure Chemical, CAS 70146-21-3), 1 part by mass of mineral oil (Wako Pure Chemical) and 795 parts by mass of dichloromethane (Wako Pure Chemical were dissolved and mixed to prepare a charge transport layer coating liquid. This charge transport layer coating liquid was applied by dip coating to an aluminum substrate to form a charge transport layer with a dried thickness of 20 μm.

120 parts by mass polycarbonate Z (Mitsubishi Gas Chemical, Iupizeta PCZ-500), 4 parts by mass of the phthalocyanine charge generating agent of metal-free phthalocyanine manufactured in Synthesis Example 1, 50 parts by mass of azoquinone electron transport agent (Takasago International, CAS 270578-51-3), 30 parts by mass of stilbene hole transport agent (Takasago International, CAS 211757-52-7), 6 parts by mass of an aromatic ester space filler (ADEKA, CAS 124906-78-1) and 790 parts by weight of dichloromethane were dispersed, dissolved and mixed to prepare a charge generating layer coating liquid.

An electrophotographic photoreceptor was manufactured by applying this charge generating layer coating liquid by dip coating atop the previous charge transport layer to form a charge generating layer with a dried thickness of 10 μm.

Comparative Example 1

An electrophotographic photoreceptor was manufactured as in Example 1 except that no aromatic ester space filler (ADEKA, CAS 124906-78-1) was added and the amount of dichloromethane was changed to 796 parts by mass in the charge generating layer coating liquid of Example 1.

Comparative Example 2

An electrophotographic photoreceptor was manufactured as in Example 9 except that the amount of mineral oil was changed to 2 parts by mass and the amount of dichloromethane to 794 parts by mass in the charge transport layer coating liquid of Example 9.

The electrical properties of the resulting electrophotographic photoreceptors of Examples 1 through 9 and Comparative Examples 1 and 2 were measured using an electrostatic paper analyzer (Kawaguchi Electric Works EPA-8200).

The surfaces of the electrophotographic photoreceptors were positively charged for 10 seconds by 5 kV corona discharge under dark conditions, and the surface charge retention rate was then measured after 5 seconds. Table 1 below shows the surface charge retention rates of each of the electrophotographic photoreceptors after 5 seconds.

Next, as one means of evaluating durability, 5 g weights were attached to both ends of 0.5 mm stainless steel wires, and these were applied the electrophotographic photoreceptors of Examples 1 through 9 and Comparative Examples 1 and 2 and left for one week at room temperature, normal humidity. The amount of creep deformation was measured. The results are shown in Table 1 below.

TABLE 1

| | Surface charge retention rate (%) after 5 seconds | Creep deformation (mm) |
|---|---|---|
| Example 1 | 97.6 | 0.0 |
| Example 2 | 97.9 | 0.0 |
| Example 3 | 97.5 | 0.0 |
| Example 4 | 97.9 | 0.0 |
| Example 5 | 98.1 | 0.0 |
| Example 6 | 98.0 | 0.0 |
| Example 7 | 97.4 | 0.0 |
| Example 8 | 97.5 | 0.0 |
| Example 9 | 97.4 | 0.0 |
| Comparative Example 1 | 97.7 | 1.6 |
| Comparative Example 2 | 97.2 | 0.7 |

It can be seen from Table 1 that the surface charge retention rate was very high after 5 seconds in all of the Examples and Comparative Examples. Satisfactory results were obtained with no creep deformation in any of the examples, but significant creep deformation in both of the comparative examples.

The invention claimed is:

1. An electrophotographic photoreceptor, comprising:

an electroconductive substrate; and a photosensitive layer disposed over the electroconductive substrate, wherein the photosensitive layer includes a charge transport layer including a resin binder including polystyrene and a hole transport agent, and mineral oil in an amount of 1% by mass or less of an amount of the polystyrene, a charge generating layer disposed over the charge transport layer, and wherein the charge generating layer includes a resin binder, a charge generating agent, a space filler and an electron transport agent.

2. The electrophotographic photoreceptor according to claim 1, wherein the hole transport agent is a triphenylamine hole transport agent.

3. The electrophotographic photoreceptor according to claim 1, wherein the hole transport agent is a stilbene hole transport agent.

4. The electrophotographic photoreceptor according to claim 1, wherein the hole transport agent is a benzidine hole transport agent.

5. The electrophotographic photoreceptor according to claim 1, wherein the hole transport agent is a hydrazone hole transport agent.

6. The electrophotographic photoreceptor according to claim 1, wherein the charge transport layer contains an antioxidant.

7. The electrophotographic photoreceptor according to claim 6, wherein the antioxidant is a phenol antioxidant.

8. The electrophotographic photoreceptor according to claim 6, wherein the antioxidant is a phosphonite antioxidant.

9. The electrophotographic photoreceptor according to claim 1, wherein the space filler is a triphenylbenzene space filler.

10. The electrophotographic photoreceptor according to claim 1, wherein the space filler is an aromatic ester space filler.

11. The electrophotographic photoreceptor according to claim 1, wherein the charge generating agent is a phthalocyanine charge generating agent.

12. The electrophotographic photoreceptor according to claim 11, wherein the phthalocyanine charge generating agent is metal-free phthalocyanine.

13. The electrophotographic photoreceptor according to claim 11, wherein the phthalocyanine charge generating agent is titanyl phthalocyanine.

14. The electrophotographic photoreceptor according to claim 1, wherein the electron transport agent is an azoquinone electron transport agent.

15. The electrophotographic photoreceptor according to claim 1, wherein the electron transport agent is a benzoquinone electron transport agent.

16. The electrophotographic photoreceptor according to claim 1, wherein the electron transport agent is naphthoquinone electron transport agent.

17. The electrophotographic photoreceptor according to claim 1, wherein the photosensitive layer is a positive-charging laminate.

18. The electrophotographic photoreceptor according to claim 1, wherein the charge generating layer is laminated on the charge transport layer.

19. A method forming a photosensitive layer for manufacturing an electrophotographic photoreceptor, the method comprising:

applying a charge generating layer coating liquid including a resin binder, a charge generating agent, a space filler and an electron transport agent over an electroconductive substrate; and applying a charge transport layer coating liquid over the charge generating layer coating liquid, the charge transport layer coating liquid including a resin binder including polystyrene and a hole transport agent, and mineral oil in an amount of 1% by mass or less of an amount of the polystyrene.

* * * * *